US005163580A

United States Patent [19]

Beach et al.

[11] Patent Number: 5,163,580

[45] Date of Patent: Nov. 17, 1992

[54] PACKAGE OF STACKED ROOFING WASHERS AND RELATED METHODS

[75] Inventors: John R. Beach, Elmhurst; Donald L. Van Erden, Wildwood, both of Ill.

[73] Assignee: Illinois Tool Works Inc., Glenview, Ill.

[21] Appl. No.: 665,157

[22] Filed: Mar. 6, 1991

[51] Int. Cl.[5] ..... B65H 1/00

[52] U.S. Cl. ..... 221/1; 221/197; 221/287; 221/312 A; 206/445; 206/493

[58] Field of Search ..... 221/1, 197, 287, 312 R, 221/312 A, 312 B, 312 C; 206/445, 493; 227/120, 15

[56] References Cited

U.S. PATENT DOCUMENTS

| | | | |
|---|---|---|---|
| 2,706,041 | 4/1955 | Tate | 206/493 X |
| 3,115,240 | 12/1963 | Flomen et al. | 206/493 X |
| 3,228,555 | 1/1966 | Pinto | 221/312 A |
| 4,752,146 | 6/1988 | Buckle | 206/493 X |

*Primary Examiner*—Robert P. Olszewski
*Assistant Examiner*—Dean A. Reichard

[57] ABSTRACT

In a package designed to be readily loaded into a magazine, stacked roofing washers are collated by means of an elongate, flexible, polymeric strap extending through central apertures of the washers. Near each end of the strap, the strap is formed with a formation, such as, for example, an overhand knot, which is capable of supporting the washers if the package is suspended from the other end of the strap. One such formation is capable of being deformed sufficiently so as to permit it to be forcibly pulled through the washer apertures. A related method of loading such washers into the magazine and a related method of packaging such washers are disclosed. Each such method involves the package noted above.

21 Claims, 2 Drawing Sheets

PACKAGE OF STACKED ROOFING WASHERS AND RELATED METHODS

TECHNICAL FIELD OF THE INVENTION

This invention pertains to a package comprising stacked roofing washers and a flexible member collating such washers, to a related method of loading such washers, disposed within such a package, into a magazine of a roofing washer-dispensing machine, and to a related method of packaging such washers within such a package.

BACKGROUND OF THE INVENTION

Versatile machines have been developed, which dispense roofing washers individually onto a roofing membrane or onto a sheet of roofing insulation, and which drive threaded fasteners through the roofing washers, into a substrate, such as, for example, a metal or wooden deck. A particularly useful example of such a machine is disclosed in a copending patent application, Ser. No. 07/432,006, now U.S. Pat. No. 5,056,684, for IMPROVEMENTS IN ROOFING WASHER DISPENSING MACHINE, which was filed Nov. 6, 1989, and which is assigned commonly herewith. The machine disclosed in the copending application comprises a magazine, which is loaded with a stack of roofing washers, and which enables such washers to be individually dispensed from the magazine by means of mechanisms disclosed within the copending application.

Often, after a prior stack has been exhausted, it is necessary for a worker standing upon a roof to reload the magazine with a new stack of roofing washes. If such washers must be individually loaded into the magazine, it is painstaking for the worker to do so, since the worker must be very careful to orient each washer properly before loading such washer into the magazine. Improperly oriented washers cannot be properly dispensed by means of the machine and can jam the machine.

A need has been created, to which this invention is addressed, for a simple, inexpensive way to collate a counted or predetermined number of similar roofing washers, whereby they can be easily loaded into the magazine of such a tool.

SUMMARY OF THE INVENTION

Broadly, this invention addresses the aforenoted need by providing a package comprising a plurality of similar, stacked roofing washers, each having a central aperture, and an elongate, flexible member collating the washers and extending slidably through the central apertures of the washers.

Preferably, within the package, the flexible member is formed with a formation near one end of the flexible member. The formation is larger than the central apertures of the washers and is capable of supporting the washers if the package is suspended from the other end of the flexible member. The formation is capable of being deformed sufficiently so as to permit the formation to be forcibly pulled through the central apertures of the washers if the flexible member is pulled forcibly from the other end of the flexible member while the washers are restrained.

In a preferred construction, the flexible member is formed with a first formation near a first end of such member and with a second formation near a second end of such member. Preferably, the flexible member and the first and second formations are constituted by means of a single piece or member, for which a single piece of flexible, polymeric strap is preferred.

The first formation is larger than the central apertures of the washers and is capable of supporting the washers if the package is suspended from the second end. The second formation is larger than the central apertures of the washers and is capable of supporting the washers if the package is suspended from the first end. The second formation is capable of being deformed sufficiently so as to permit the second formation to be forcibly pulled through the central apertures of the washers if the flexible member is pulled forcibly from the first end while the washers are restrained. It is preferred that the second formation is an overhand knot, which is tightened sufficiently so as to avert slippage of such knot, but which can be sufficiently deformed.

In a simple construction, which is preferred, each of the first and second formations is such an overhand knot. In any event, whether or not such an overhand knot is used for each formation, it is preferred that the first and second formations are similar. The utility of the flexible member is enhanced, however, if the first formation is a finger loop which is formed by looping the strap over itself and by welding the strap where it is looped over itself. The finger loop facilitates pulling the flexible member forcibly from the first end.

In an alternate construction contemplated by this invention, at least one of the first and second formations is a flag, which is formed by folding the strap onto itself, along a diagonal line, and by welding the strap where it is folded onto itself.

This invention provides a related method of loading a plurality of similar roofing washers, each having a central aperture, into a magazine of a machine used to dispense the washers individually. The magazine comprises a substantially box-like container having an open face and having two side walls, a wall disposed opposite to the open face, a wall defining a closed end, and an opposite end, which is flanged. The flanged end restrains a lowermost one of the washers against dropping through the flanged end if the magazine is disposed in an upright position with the closed end above the flanged end after the washers have been loaded into the magazine. The magazine may be substantially similar to the magazine disclosed within the copending patent application noted above.

The loading method comprises providing the washers within a package, as provided by means of this invention, and disposing the package within the magazine, by means of the open face, such that the formation capable of being deformed is near the end opposite to the flanged end. Furthermore, the loading method comprises pulling the flexible member form its other end while the endmost one of the washers is restrained by means of the flanged end, such that such formation is deformed sufficiently so as to permit such formation to be forcibly pulled through the central apertures of the washers. Pulling upon the flexible member is continued until the flexible member is removed from the washers.

This invention provides a method of packaging a plurality of similar roofing washers, each washer having central aperture, within the package provided by means of this invention. The packaging method comprises stacking the roofing washers within a receptacle having an open face and having two side walls, a wall disposed opposite to the open face, a first end wall, and a second end wall. Also, each end wall has a portal, which is aligned with the portal of the other end wall. The packaging method comprises threading an elongate, flexible, member, preferably an elongate, flexible, polymeric strap, through the central apertures of the washers, and forming a leading end of the flexible member with a formation which has a diameter which is larger than the diameter of such apertures. The packaging method comprises removing the washers and the flexible member with the formation near the leading end, as a package, from the receptacle. It is preferred that the trailing end is formed with a similar formation before the flexible member is threaded through such apertures.

The packaging method contemplates the fact that the formation near the leading end is capable of supporting the washers if the package is suspended from the other end of the flexible member. The packaging method contemplates, moreover, that the formation near the leading end is capable of being deformed sufficiently so as to permit the formation near the leading end to be forcibly pulled through the central apertures of the washers if the flexible member is pulled forcibly from the trailing end of the flexible member while the washers are restrained.

When the packaging method is practiced, each of the formations may be advantageously formed by tying an overhand knot, which is tightened sufficiently so as to avert slippage of such knot, but which can be sufficiently deformed.

BRIEF DESCRIPTION OF THE DRAWINGS

These and other Objects, features, and advantages of this invention will become evident from the following description of a preferred embodiment of the package provided by means of this invention and the preferred modes for carrying out the related methods provided by means of this invention, with reference to the accompanying drawings, in which like reference characters designate like or corresponding parts throughout the several views, and wherein.

DETAILED DESCRIPTION OF ILLUSTRATED EMBODIMENTS

Figure 1:
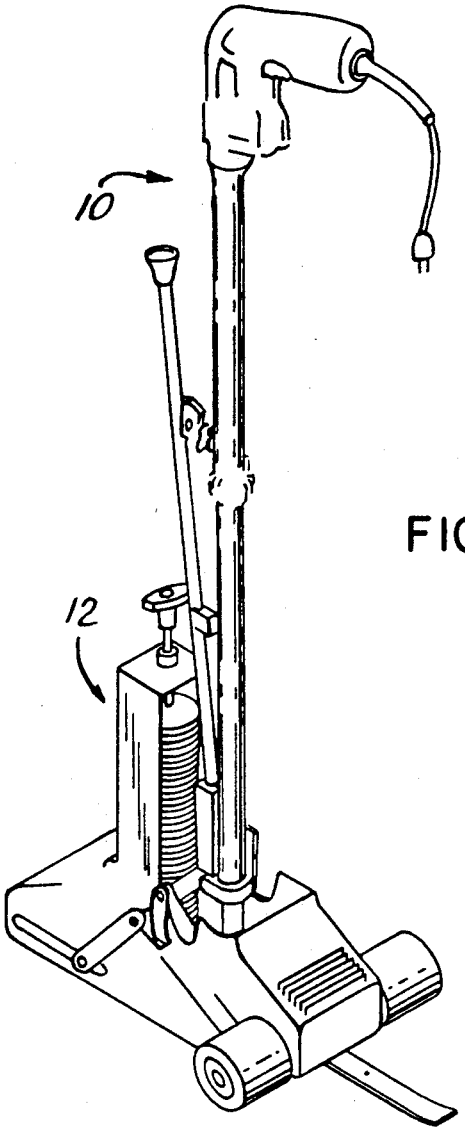
FIG. 1 is a perspective view of a roofing washer-dispensing and fastener-driving machine having a magazine, with which the package provided by means of this invention may be advantageously used.
Figure 8:
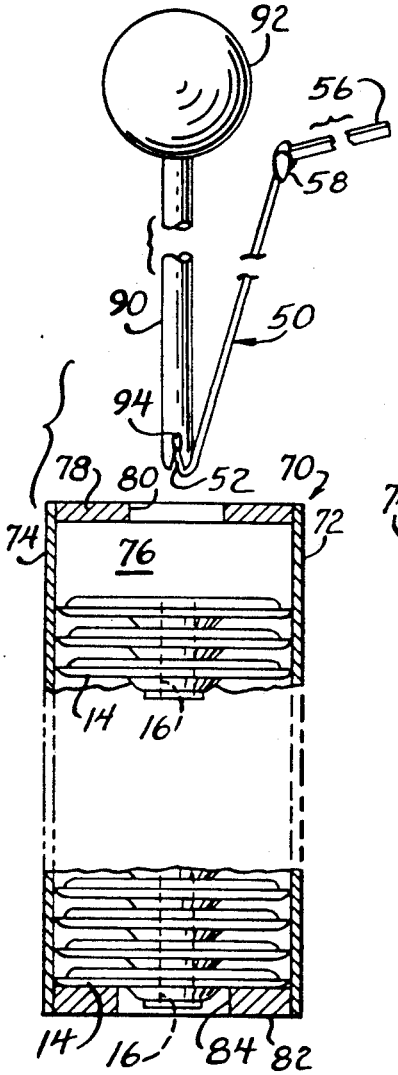
FIGS. 8, 9, and 10, on a further enlarged scale, are partly fragmentary, plan views of a receptacle useful in making the package provided by means of this invention, a stack of similar roofing washers disposed within the receptacle, and a lance useful in threading a flexible strap through the stacked washers, at several successive stages of making the package of stacked washers.
Figure 9:
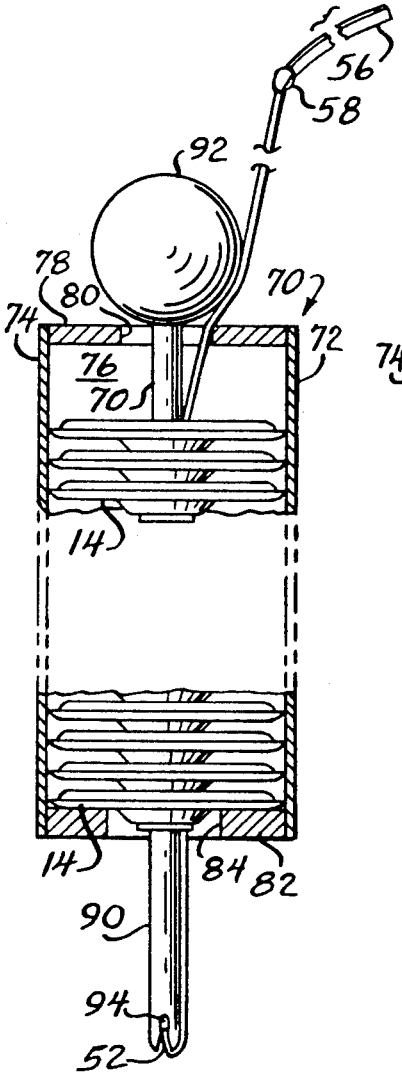
Figure 10:
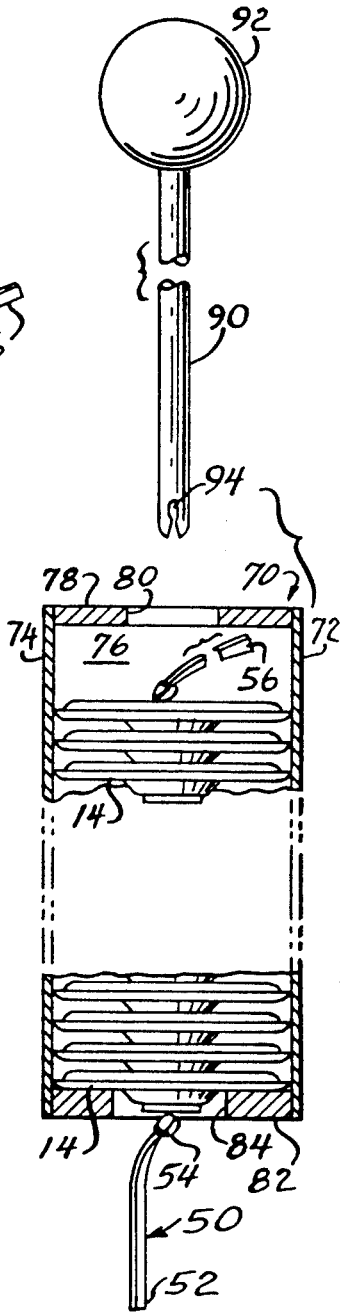

As shown in FIG. 1, a roofing washer-dispensing and fastener-driving machine 10 having a magazine 12 is similar to the roofing washer-dispensing and fastener-driving machine disclosed within the application, Ser. No. 07/432,006, now U.S. Pat. No. 5,056,684, IMPROVEMENTS IN ROOFING WASHER DISPENSING MACHINE, which was filed November 6, 1989, which is assigned commonly herewith, and the disclosure of which is incorporated herein by reference. The magazine 12 is similar to the magazine disclosed within the same oopending application. This invention enables the magazine to be easily filled with a stack of similar roofing washers 14 having central apertures 16 (see, for example, FIG. 8) and disposed within a package 20 constituting a preferred embodiment of this invention.

Figure 6:
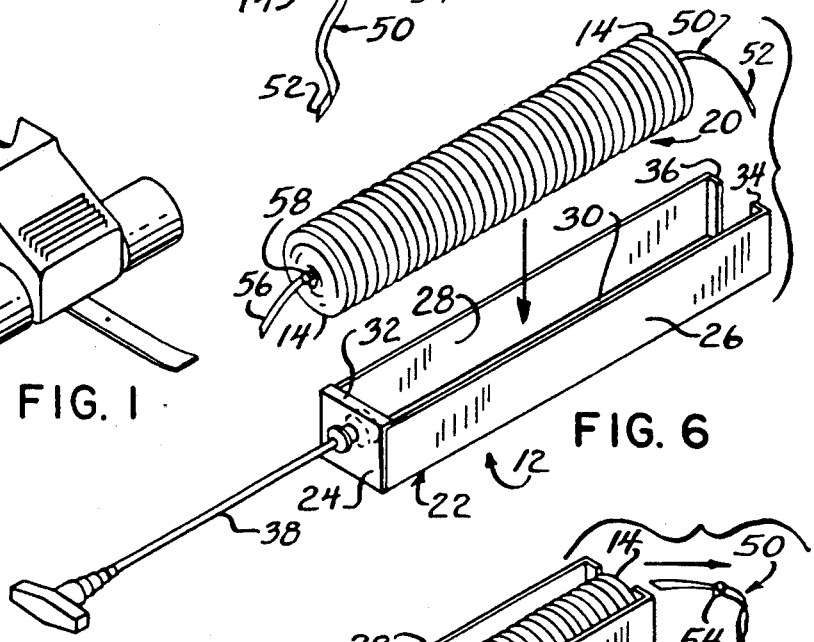
FIG. 6, on an intermediate scale compared to FIGS. 1 and 2, is a perspective view of the magazine, as removed from the machine of FIG. 1 and as readied to receive a package such as, for example, the package of FIG. 2.
Figure 7:
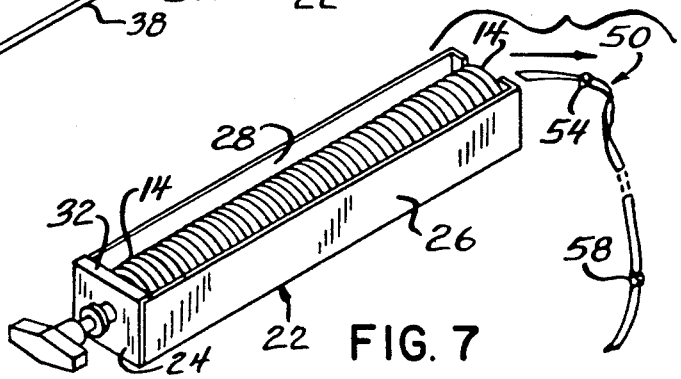
FIG. 7, on the intermediate scale, is a perspective view of the magazine and the package, as loaded into the magazine, after the flexible strap has been pulled from the washers disposed within the magazine.

The magazine 12 is removable from the machine 10, in a manner disclosed within the copending application noted above, when it is necessary to fill the magazine 12 with such washers 14. As shown in FIGS. 6 and 7, the magazine 12 comprises a substantially box-like container 22, which has a substantially open face and which has a top or end wall 24, two side walls 26, 28, and a wall 30 disposed opposite to the substantially open face. The substantially open face is open between the side walls 26, 28, substantially to the top or end wall 24, near which the open face is bounded by means of a narrow strip 32 extending between the side walls 26, 28, and reinforcing the container 22. The container 22 has a closed end, which is defined by means of the top or end wall 24, and a flanged end, which is disposed opposite to the closed end. The flanged end is defined by means of a flange 34 extending inwardly from the side wall 26 and by means of the flange 36 extending inwardly from the side wall 28. The container 22 is open at the flanged end, except for the flanges 34, 36.

The magazine 12 further comprises an elongate, substantially rigid rod 38, which is removably mounted upon the top or end wall 24, within a manner disclosed in the copending patent application noted above. The rod 38 is mounted so that, when it is withdrawn sufficiently (see FIG. 6) or when it is removed completely from the top or end wall 24, the container 22 is ready to receive a stack of the washers 14. The rod is mounted so that, when it is installed in an operative position (see FIG. 7) in a manner disclosed within the same copending patent application, the rod 38 extends through the central apertures 16 of the washers 14 within the magazine 12, except for the lowermost washer 14 supported by means of the flanges 34, 36, when the magazine 12 is disposed in an upright position with the closed end disposed above the flanged end Further details of the magazine 12 are disclosed within the same copending patent application.

Each washer 14 may be advantageously made from a stamped, metal plate having a circular periphery and from a molded, polymeric insert affixed to the metal plate. Suitable roofing washers made therefrom are available commercially from ITW Buildex (a unit of Illinois Tool Works Inc.) of Itasca, Ill. A roofing washer preferred for each washer 14 is disclosed within a copending patent application, U.S. Ser. No. 07/621,314, now U.S. Pat. No. 5,082,412, for IMPROVED ROOFING WASHER, which was filed Dec. 3, 1990, which is assigned commonly herewith, and the disclosure of which is incorporated herein by reference.

Figure 2:
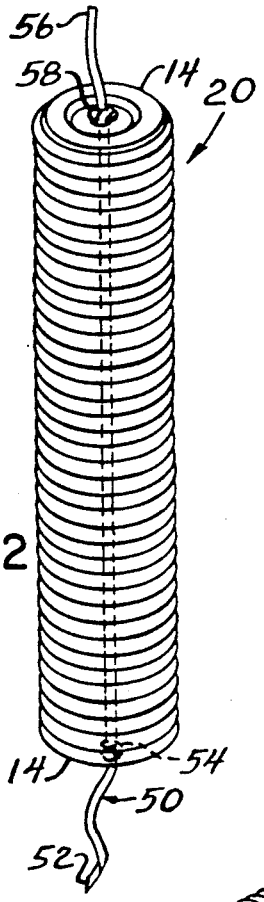
FIG. 2, on an enlarged scale compared to that of FIG. 1, is a perspective view of a preferred embodiment of the package provided by means of this invention.

As shown in FIG. 2, the package 20 comprises a counted or predetermined number (for example, forty-four, as shown) of the washers 14 disposed with a stack, in which each washer 14 has a similar top-to-bottom orientation, and an elongate, flexible, polymeric strap 50 collating the washers 14 and extending through the central apertures 16 of the washers 14. A preferred strap for the strap 50 is a polypropylene strap having waffled surfaces and having a nominal width of 5 mm and a nominal gauge of 0.03 mm prior to waffling, as available commercially from Signode System GmbH (a unit of Illinois Tool Works Inc.) of Dinslaken, Germany.

Near a first end 52 of the strap, the strap 50 is formed with a first formation 54, which is larger in diameter than the diameters of the central apertures 16 of the washers 14. Near a second end 56 of the strap, the strap 50 is formed with a second formation 58, which also is larger in diameter than the diameters of such apertures 16. The first formation 54 is capable of supporting the washers 14 if the package 20 is suspended, in its orientation in FIG. 2, from the second end 56 of the strap 50. The second formation 58 is capable of supporting the washers 14 if the package 20 is suspended, in an orientation inverted from its orientation of FIG. 2, from the first end 52 of the strap 50. The second formation 58 is capable of being deformed sufficiently so as to permit the second formation 58 to be forcibly pulled through the central apertures 16 of the washers if the strap 50 is pulled forcibly from the first end 52 while the washers 14 are restrained.

Figure 5:
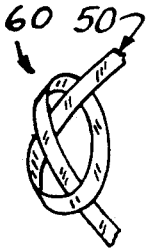
FIG. 5 is a similarly enlarged, fragmentary detail of an overhand knot, as formed at each end of the flexible strap in the preferred embodiment of FIG. 2, before the overhand knot is tightened.

As shown in FIGS. 2, 6, and 7, the first formation 54 and the second formation 58 are similar to each other, each being an overhand knot, such as, for example, the overhand knot 60 shown (before it is tightened) in FIG. 5. An overhand knot is preferred because it is simple to tie, because it is capable of supporting the washers 14, as mentioned above, and because it is capable of becoming deformed sufficiently, as mentioned above.

Figure 3:
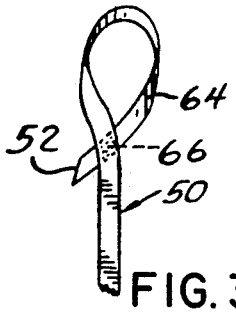
FIGS. 3 and 4 are further enlarged, fragmentary details of alternate formations formed at one end of a flexible strap, which is used in the preferred embodiment of FIG. 2.
Figure 4:
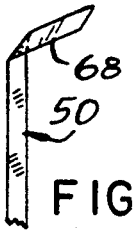

As shown in FIG. 3, the first formation 54 may be alternatively formed as a finger loop 64, which is formed by looping the strap 50 over itself and by welding the strap 50 where the strap 50 is looped over itself. As shown in FIG. 4, the first formation 54, the second formation 58, or both may be alternatively formed as a flag 68, which is formed by folding the strap 50 onto itself, along a diagonal line, and by welding the strap where it is folded onto itself. In either instance, any known technique for welding a polymeric strap is useful, such as, for example, ultrasonic welding or welding with a blade (not shown) heated sufficiently.

In loading the magazine 12 in accordance with a preferred method, the package 20 is disposed within the container 22, through means of the open face of the container 22. The package 20 is disposed therein such that the second formation 58 is near the closed end defined by means of the top or end wall 24 and such that the first formation 54 is disposed near the flanges 34, 36, at the flanged end of the container 22. Furthermore, the strap 50 is pulled from its first end 52 while the lowermost or endmost one of the washers 14 disposed within the magazine 12 is restrained by means of the flanges 34, 36, at the flanged end of the container 22, such that the second formation 58 is deformed sufficiently so as to permit the second formation 58 to be forcibly pulled through the central apertures 16 of the washers 14 disposed within the magazine 12. Pulling upon the strap is continued until the strap 50 is removed from the washers 14 disposed within the magazine 12.

In packaging the washers 14 within the package 20 by means of the preferred method, a receptacle 70 is used, which has an open face and which has two side walls 72, 74, a wall 76 disposed opposite to the open face, a first end wall 78 having a portal 80, and a second end wall 82 having a portal 84. The portals 80, 84, which are U-shaped so as to be open at the open face of the receptacle 70, are centered within the end walls 78, 82, and are coaxially aligned with respect to each other. After the second formation 58 has been formed near the second end 56 of the strap 50 by tying an overhand knot such as the overhand knot 60, a lance 90 is used. The lance 90 has a gripping end, to which a knob 92 is affixed, and a working end, which has a notch 94 that is shaped so as to frictionally retain the first end 52 of the strap 50 when the strap is doubled back along the lance 90. The lance 90 is used to thread the strap 50 (with the first end 52 being a leading end and the second end 56 being a trailing end) through the portal 80 of the first end wall 78, through the central apertures 16 of the washers within the receptacle 70, and through the portal 84 of the second end wall 82. Subsequently, the first end 52 of the strap 50 is removed from the notch 94 defined within the working end of the lance 90, the lance 90 is withdrawn through the portal 84 of the second end wall 82, and the first formation 54 is formed near the first end 52 of the strap 50. The washers 14 and the strap 50, with the first formation 54 and the second formation 58 secured therein, then constitute the package 20, which is removed from the receptacle 70.

Various modifications may be made in the preferred embodiment described and in the preferred methods described above without departing from the scope and spirit of this invention. It is therefore understood that within the scope of the appended claims, the present invention may be practiced otherwise than as specifically described herein.

We claim:

1. A package, comprising:

a plurality of similar, stacked roofing washers, each having a central aperture defined therein; and an elongate, flexible member collating said washers together and extending through said central apertures thereof;

said elongate, flexible member having a formation formed at at least one end thereof which is larger than said central apertures of said washers such that said washers can be supported upon said formation when said package is suspended from an opposite end of said elongate, flexible member;

said formation being capable of being sufficiently deformed so as to permit said formation to be forcibly pulled through said central apertures of said washers if said elongate, flexible member is forcibly pulled from the other end thereof while said washers are restrained; and said elongate, flexible member and said formation thereof comprising a single, flexible, elongated packaging component.

2. A package as set forth in claim 1, wherein:

said formation comprises an overhand knot which is tightened sufficiently so as to avert slippage thereof but which can be sufficiently deformed.

3. A package as set forth in claim 1, wherein:

said elongated flexible member and said formation thereof comprise a single piece of flexible, polymeric strap.

4. A package as set fort in claim 3, wherein:

said polymeric strap comprises polypropylene.

5. A package as set forth in claim 3, wherein:

said formation comprises a flag which is formed by folding said strap onto itself along a diagonal line and welding said strap where it is folded onto itself.

6. A package, comprising:

a plurality of similar, stacked roofing washers, each having a central aperture defined therein; and an elongate, flexible member collating said washers together and extending through said central aperture thereof;

said elongate flexible member being formed with a first formation near a first end of said elongate flexible member and with a second formation near a second end of said elongate flexible member, said first formation being larger than said central apertures of said washers so as to be capable of supporting said washers if said package is suspended from said second end of said elongate flexible member, said second formation being larger than said central apertures of said washers so as to be capable of supporting said washers if said package si suspended from said first end of said elongate flexible member;

said second formation being capable of being deformed sufficiently so as to permit said second formation to be forcibly pulled through said central apertures of said washers if said elongate flexible member is pulled forcibly from said first end thereof while said washers are restrained; and said elongate, flexible member and said first and second formations thereof comprising a single, flexible, elongated packaging component.

7. The package of claim 3 wherein the flexible member and the first and second formation are constituted by a single piece of flexible, polymeric strap.

8. The package of claim 7 wherein the first formation is a finger loop, which is formed by looping the strap over itself and by welding the strap where the strap is looped over itself.

9. The package of claim 8 wherein the second formation is an overhand knot, which is tightened sufficiently to avert slippage of such knot, but which can be sufficiently deformed.

10. The package of claim 7 wherein at least one of the first and second formation is a flag, which is formed by folding the strap onto itself, along a diagonal line, and by welding the strap where it is folded onto itself.

11. The package of claim 7 wherein the first and second formations are similar.

12. The package of claim 11 wherein each of the first and second formations is an overhand knot, which is tightened sufficiently to avert slippage of such knot, but which can be sufficiently, deformed.

13. A method of loading a plurality of similar roofing washers into a magazine of a machine used to dispense said washers individually, each washer having a central aperture defined therein, said magazine having an open front, two side walls, a back wall, a closed end, and an opposite end which is flanged so as to restrain an endmost one of said washers against dropping through said flanged end if said magazine is disposed in an upright position with said closed end disposed above said flanged end after said washers have been loaded into said magazine, the method comprising the steps of providing said washers in a package in which said washers are stacked and are collated together by means of an elongate, flexible member extending through said central apertures of said washers, said elongate flexible member being formed with a formation near one end of said elongate flexible member, said formation being larger than said central apertures of said washers and being capable of supporting said washers if said package is suspended from the other end of said elongate flexible member, said formation also being capable of being deformed sufficiently so as to permit said formation to be forcibly pulled through said central apertures of said washers if said elongate flexible member is pulled forcibly from said other end while said washers are restrained;

disposing said package within said magazine by mans of said open front such that said formation is disposed near said closed end of said magazine; and pulling said elongate flexible member from said other end while said endmost one of said washers disposed within said magazine and disposed adjacent to said flanged end of said magazine is restrained by said flanged end of said magazine such that said formation is deformed sufficiently so as to permit said formation to be forcibly pulled through said central apertures of said washers until said elongate flexible member is removed from said washers disposed within said magazine.

14. A method as set forth in claim 13, wherein:

said formation comprises an overhand knot which is tightened sufficiently so as to avert slippage thereof but which can be sufficiently deformed.

15. The method of claim 13 wherein the flexible member is an elongate, flexible, polymeric strap having a similar formation near each end of the strap.

16. A method as set forth in claim 15, wherein:

said strap comprises polypropylene.

17. A method of packaging a plurality of similar roofing washers, each having a central aperture defined therein, the method comprising the steps of;

stacking said roofing washers within a receptacle having an open front, opposite side walls, a back wall, a first end wall, and a second end wall, each end wall having a portal aligned with the portal of the other end wall;

threading an elongate flexible member, having a leading end and a trailing end, through said portal of said first end wall, through said central apertures of said washers, and through said portal of said second end wall, such that said leading end of said elongate flexible member precedes said trailing end of said elongate flexible member;

forming said elongate flexible member, near said leading end thereof, with a formation which is larger than said central apertures of said washers and removing said washers and said elongate flexible member with said formation formed near said leading end thereof, as a package, from said receptacle;

wherein said formation formed near said leading end of said elongate flexible member is capable of supporting said washers if said package is suspended from said trailing end of said elongate flexible member and wherein said formation formed near said leading end of said elongate flexible member is capable of being deformed sufficiently so as to permit said formation formed near said leading end of said elongate flexible member to be forcibly pulled through said central apertures of said washers if said elongate flexible member is pulled forcibly from said trailing end of said elongate flexible member while said washers are restrained.

18. The method of claim 17 wherein the trailing end is formed with a similar formation before the flexible member is threaded through the central; apertures of the washers.

19. The method of claim 18 wherein each of the similar formations is formed by tying an overhand knot, which is tightened sufficiently to avert slippage of such knot, but which can be sufficiently deformed so as to permit one of the leading and trailing end formations to be forcibly pulled through the central apertures of the washers, if the flexably member is pulled forcibly from an opposite end of the flexible maker while the washers are restrained.

20. The method as set forth in claim 17, wherein:

said elongated flexible member and said formation thereof comprise a single piece of flexible, polymeric strap.

21. The method as set forth in claim 20, wherein:

said polymeric strap comprises polypropylene.

* * * * *